US009257072B2

(12) United States Patent
Han

(10) Patent No.: US 9,257,072 B2
(45) Date of Patent: Feb. 9, 2016

(54) POWER CONTROL DEVICE AND METHOD FOR A DISPLAY DEVICE

(71) Applicant: SAMSUNG DISPLAY CO., LTD., Yongin, Gyeonggi-do (KR)

(72) Inventor: Sang-Myeon Han, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 104 days.

(21) Appl. No.: 14/046,724

(22) Filed: Oct. 4, 2013

(65) Prior Publication Data

US 2014/0347339 A1 Nov. 27, 2014

(30) Foreign Application Priority Data

May 27, 2013 (KR) ..... 10-2013-0059849

(51) Int. Cl.
*G09G 3/32* (2006.01)

(52) U.S. Cl.
CPC ..... *G09G 3/3233* (2013.01); *G09G 2320/0271* (2013.01); *G09G 2320/064* (2013.01); *G09G 2330/021* (2013.01); *G09G 2360/16* (2013.01)

(58) Field of Classification Search
CPC ..... G09G 3/3696; G09G 3/3233; G09G 2330/021; G09G 3/3258; G09G 2300/0819; G09G 2310/0289; G09G 2300/0842; G09G 2320/043; G09G 3/3291
See application file for complete search history.

(56) References Cited

U.S. PATENT DOCUMENTS

| | | | | |
|---|---|---|---|---|
| 2005/0190165 | A1* | 9/2005 | Wendling | 345/204 |
| 2006/0164408 | A1* | 7/2006 | Nishikawa et al. | 345/207 |
| 2008/0204475 | A1* | 8/2008 | Kim et al. | 345/660 |
| 2012/0044270 | A1* | 2/2012 | Arkhipov et al. | 345/690 |

FOREIGN PATENT DOCUMENTS

| | | |
|---|---|---|
| KR | 10-2006-0082987 | 7/2006 |
| KR | 10-2007-0002891 | 1/2007 |
| KR | 10-0844774 | 7/2008 |
| KR | 10-2012-0017968 | 2/2012 |

* cited by examiner

*Primary Examiner* — Olga Merkoulova
(74) *Attorney, Agent, or Firm* — F. Chau & Associates, LLC

(57) ABSTRACT

Disclosed is a power control device for a display device, including: a current scaling factor calculation unit calculating a current scaling factor according to an input data signal and a load of the input data signal; a data scaling unit generating a data scaling factor based on the current scaling factor and scaling a data signal corresponding to light emitting gradation of a pixel; and a gamma scaling unit generating a gamma scaling factor based on the current scaling factor and scaling a gamma value for gamma correction of a data signal.

13 Claims, 5 Drawing Sheets

POWER CONTROL DEVICE AND METHOD FOR A DISPLAY DEVICE

CROSS-REFERENCE TO RELATED APPLICATION

This application claims priority to Korean Patent Application No. 10-2013-0059849 filed in the Korean Intellectual Property Office on May 27, 2013, the entire disclosure of which is incorporated by reference herein in its entirety.

TECHNICAL FIELD

Exemplary embodiments of the present invention relate to displays, and more particularly, to a power control device and method for a display device.

DISCUSSION OF THE RELATED ART

An organic light emitting diode (OLED) display includes a plurality of pixels for emitting light, and each pixel of the OLED display includes an organic light emitting diode (OLED). The OLED generates light having a predetermined luminance corresponding to a data current supplied from a pixel circuit.

When the data current is supplied to the OLED without any limitations, power consumption may increase.

SUMMARY

An exemplary embodiment of the present invention provides a power control device for a display device. The power control device includes a current scaling factor calculation unit. The current scaling factor calculation unit calculates a current scaling factor according to an input data signal and a load of the input data signal. A data scaling unit generates a data scaling factor based on the current scaling factor and scales a data signal corresponding to a light emitting gradation of a pixel of the display device. A gamma scaling unit generates a gamma scaling factor based on the current scaling factor and scales a gamma value for gamma correction of the data signal.

The current scaling factor calculation unit calculates the current scaling factor using the following Equation:

$$(I_SF)*(\text{Load})^P=\text{NPC Limit}$$

Here, I_SF represents the current scaling factor, Load represents the load of the input data signal, and P represents a load coefficient which satisfies $0<P\leq 1$.

The power control device further includes a light emitting duty scaling unit. The light emitting duty scaling unit generates a light emitting scaling factor based on the current scaling factor and scales a light emitting duty of the pixel. The power control device may further include a timing filter. The timing filter generates an over-current scaling factor by recalculating the current scaling factor.

The timing filter, when calculating of the over-current scaling factor, uses an over-current load coefficient P_OC different from the load coefficient used to calculate the current scaling factor. The over-current load coefficient is larger than the load coefficient.

The current scaling factor, the data scaling factor, the gamma scaling factor, and the light emitting duty scaling factor satisfy the following Equation:

(the data scaling factor)*(the gamma scaling factor)*(the light emitting duty scaling factor)=(the current scaling factor)

According to an exemplary embodiment of the present invention, a power control device for a display device includes a current scaling factor calculation unit. The current scaling factor calculation unit calculate a current scaling factor using the following Equation:

$$(I_SF)*(\text{Load})^P=\text{NPC Limit}$$

where, I_SF is the current scaling factor, Load is a load of a data signal corresponding to a light emitting gradation of a pixel of the display device, and P is a load coefficient which satisfies $0<P\leq 1$.

A data scaling unit generates a data scaling factor based on the current scaling factor and scales the data signal. A gamma scaling unit generates a gamma scaling factor based on the current scaling factor and scales a gamma value for gamma correction of the data signal.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EMBODIMENTS

Figure 1:
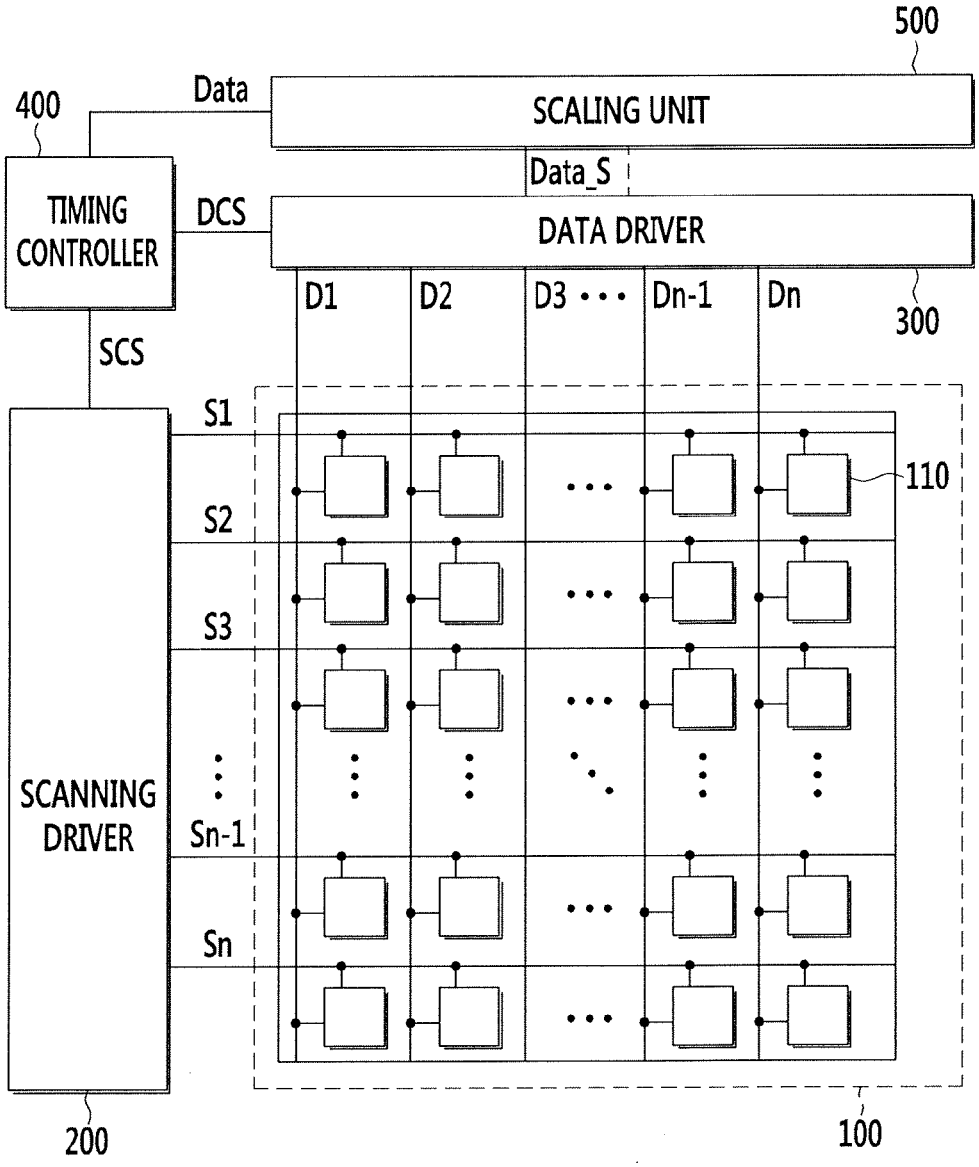
FIG. 1 is a view showing a display device according to an exemplary embodiment of the present invention.

Hereinafter, exemplary embodiments of the present invention will be described in detail with reference to the accompanying drawings. The present invention, however, may be embodied in various different forms and should not be construed as being limited to the embodiments set forth herein.

The same reference numerals may be used to denote the same or substantially the same components throughout the drawings and the specification.

As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present.

FIG. 1 is a view showing a display device according to an exemplary embodiment of the present invention.

Referring to FIG. 1, the display device includes a display unit 100 including a plurality of pixels 110 connected to scanning lines S1 to Sn and data lines D1 to Dm, a scanning driver 200 driving pixels respectively connected to the scanning lines S1 to Sn by supplying scanning signals to the scanning lines S1 to Sn, respectively, a data driver 300 driving pixels respectively connected to the data lines D1 to Dm by supplying data signals to the data lines D1 to Dm, respectively, a timing controller 400 for controlling the scanning driver 200 and the data driver 300, and a scaling unit 500.

The timing controller 400 generates a data driving control signal DCS and a scanning driving control signal SCS corresponding to a synchronizing signal supplied from an external circuit. The data driving control signal DCS and the scanning driving control signal SCS generated by the timing controlling unit 400 are supplied to the data driver 300 and the scan driver 200, respectively.

The timing controller 400 converts an image signal supplied from an external circuit into a data signal Data and supplies the data signal to the scaling unit 500.

The scaling unit 500 generates a scaling data signal Data_S by scaling the data signal Data supplied from the timing controller 400 and supplies the Data_S to the data driver 300. The scaling unit 500 generates a gamma scaling factor that is applied when correcting a gamma value and scales the gamma value. The scaling unit 500 generates a light emitting duty scaling factor and scales a light emitting duty ratio.

As used herein, the scaling refers to generating a scaling factor and multiplying a value by the generated scaling factor. For example, the scaling is to adjust a value by a scaling factor. For example, the scaling may include, but is not limited to, generating a scaled current SI by multiplying an input current by a current scaling factor I_SF or may include, but is not limited to, generating a scaling data signal Data_S by multiplying a data signal Data by a data scaling factor Data_SF.

The data driver 300 receives a plurality of scaling data signals Data_S from the scaling unit 500, and the data driver 300 supplies a plurality of data voltage to their corresponding pixels according to the data driving control signal DCS.

The data driver 300, in synchronization with when scanning signals having gate on voltages corresponding to the scanning lines S1 to Sn, respectively, is supplied to the scanning lines S1 to Sn, respectively, transfers a plurality of data voltages for controlling a plurality of pixels 110 through the plurality of data lines D1 to Dm to the plurality of pixels 110.

The gate on voltages each have a level at which a switching transistor may be turned on so that a data voltage is transferred to a gate electrode of a driving transistor for transferring a driving current to an organic light emitting diode. A detailed description thereof will be described below with reference to FIG. 2.

The scanning driver 200 supplies a scanning signal having a gate on voltage to its corresponding scanning line among the plurality of scanning lines S1 to Sn in synchronization with the beginning of each frame. Thus, a plurality of pixels 110 connected to the scanning line to which the scanning signal having the gate on voltage is supplied among the plurality of scanning lines S1 to Sn is selected. The plurality of pixels 110 selected by the scanning signal receives the data voltages from the plurality of data lines D1 to Dm.

A first power supply ELVDD and a second power supply ELVSS, respectively, supply two driving voltages for operating the plurality of pixels 110 to the plurality of pixels 110. The two driving voltages include a first driving voltage of a high level supplied from the first power supply ELVDD and a second driving voltage of a low level supplied from the second power supply ELVSS.

Figure 2:
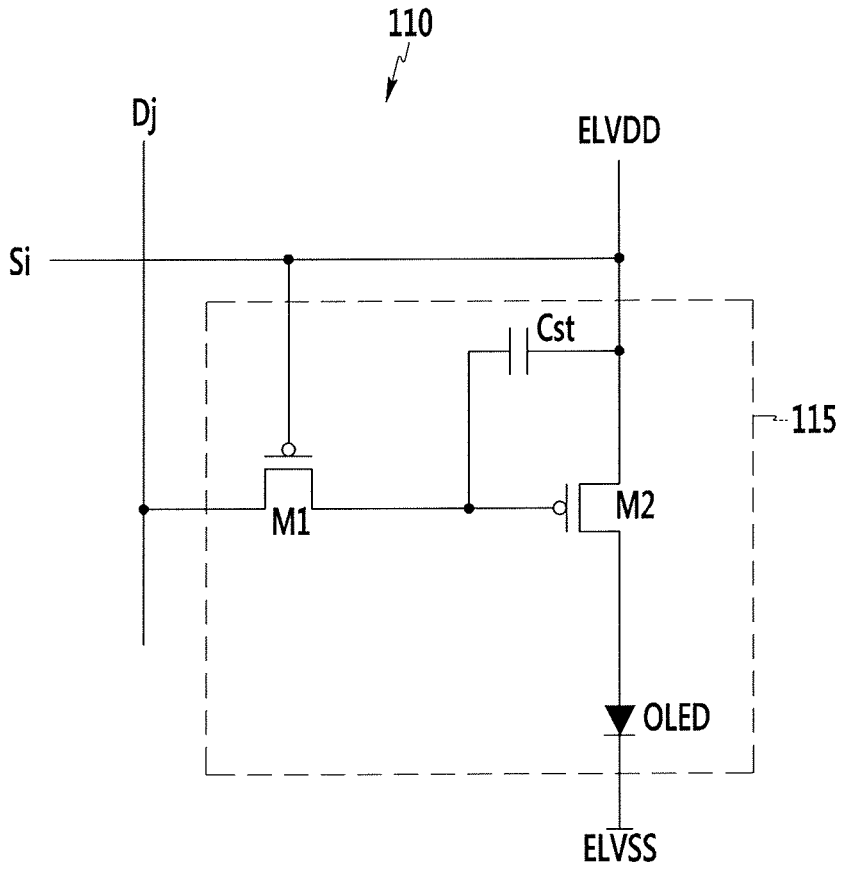
FIG. 2 is a view showing a pixel circuit of a pixel connected to an i-th scanning line and a j-th data line among a plurality of pixels in a display device of FIG. 1, according to an exemplary embodiment of the present invention.

FIG. 2 is a view showing a pixel circuit 115 of a pixel 110 connected to an i-th scanning line Si and a j-th data line Dj among a plurality of pixels in a display device of FIG. 1, according to an exemplary embodiment of the present invention. Here, $1 \leq i \leq n$ and $1 \leq j \leq m$.

Referring to FIG. 2, the pixel circuit 115 includes a switching transistor M1, a driving transistor M2, a storage capacitor Cst, and an organic light emitting diode (OLED). However, exemplary embodiments of the present invention are not limited thereto.

The switching transistor M1 includes a gate electrode connected to its corresponding scanning line among a plurality of scanning lines S1 to Sn, a source electrode connected to its corresponding data line among a plurality of data lines D1 to Dn, and a drain electrode connected to an end of the storage capacitor Cst and a gate electrode of the driving transistor M2.

The driving transistor M2 includes the gate electrode connected to the drain electrode of the switching transistor M1, a source electrode connected to the first power ELVDD, and a drain electrode connected to an anode electrode of the organic light emitting diode (OLED).

The storage capacitor Cst has an end connected to the drain electrode of the switching transistor M1 and the gate electrode of the driving transistor M2 and another end connected to the source electrode of the driving transistor M2. The source capacitor Cst maintains a voltage difference between the gate electrode and source electrode of the driving transistor M2.

The anode electrode of the organic light emitting diode (OLED) is connected to the drain electrode of the driving transistor M2 and the cathode electrode thereof is connected to the second power ELVSS.

When the switching transistor M1 is turned on by a scanning signal transferred through its corresponding scanning line, a data voltage is transferred through the turned-on switching transistor M1 to the gate electrode of the driving transistor M2. Therefore, a voltage difference between the gate electrode and source electrode of the driving transistor M2 is substantially the same as a voltage difference between the data voltage and a first driving voltage of the first power ELVDD, and a driving current flowing through the driving transistor M2 is determined depending on the voltage difference.

The driving current is transferred to the organic light emitting diode (OLED), and accordingly, the organic light emitting diode (OLED) emits light.

When a plurality of the scanning signals each having a gate on voltage level is supplied to their corresponding scanning lines among the plurality of the scanning lines S1 to Sn, a plurality of the switching transistors M1 connected to their corresponding scanning lines is turned on. Each of the plurality of the data lines D1 to Dm is supplied with a data voltage in synchronization with when the scanning signals each having the gate on voltage are supplied to their corresponding switching transistors M1.

The data voltage supplied to each of the plurality of data lines D1 to Dm is transferred through a corresponding turned-on switching transistor M1 to the gate electrode of a corresponding driving transistor M2, and thus, the organic light emitting diode (OLED) of a corresponding pixel 110 emits light.

Figure 3:
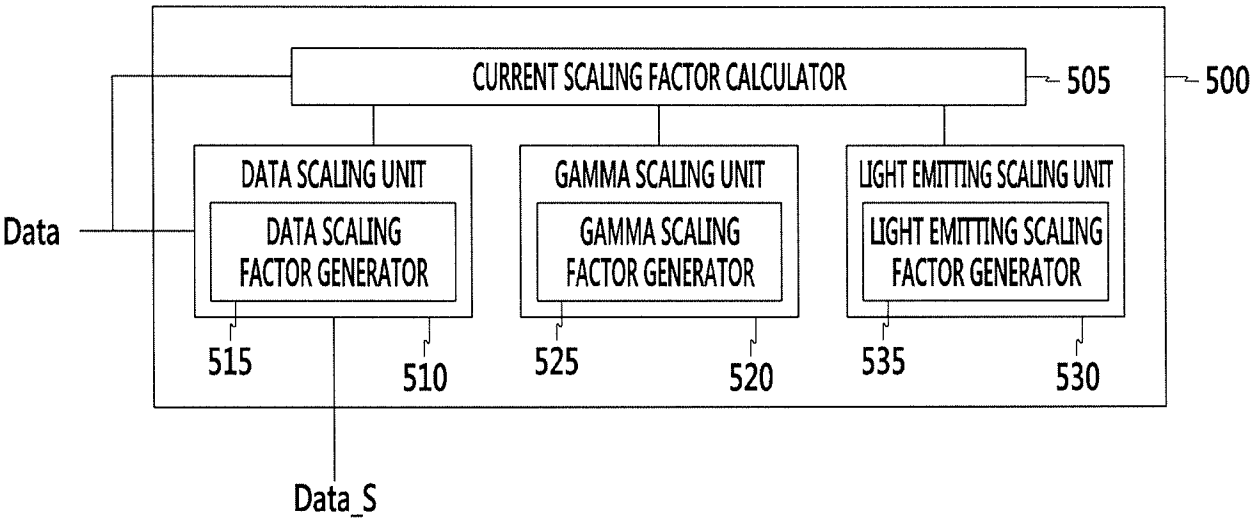
FIG. 3 is a view showing a configuration of a scaling unit according to an exemplary embodiment of the present invention.

FIG. 3 is a view showing a configuration of a scaling unit 500 according to an exemplary embodiment of the present invention.

Referring to FIG. 3, the scaling unit 500 includes a current scaling factor calculation unit 505, a data scaling unit 510, a gamma scaling unit 520, and a light emitting duty scaling unit 530.

The current scaling factor calculation unit 505 calculates a current scaling factor I_SF using an input data signal Data and a load Load of the input data signal Data.

To calculate the current scaling factor I_SF, a variable such as a net power control (NPC) is introduced. According to the following Equation 1, a current may be scaled:

$$(I_SF)*(Load)^P = \text{NPC Limit} \quad \text{[Equation 1]}$$

In Equation 1, I_SF represents the current scaling factor I_SF and Load represents the load of an input data signal. The load is a sum of currents flowing to all of the plurality of pixels when the current is assumed to be 100% upon emission of full-white light without any limitations. P is a load coefficient and is a constant, which satisfies $0<P\leq 1$.

As shown in Equation 1, the current scaling factor I_SF is multiplied by the load raised to the power of P to be NPC Limit. NPC Limit may be randomly determined by users. Since NPC Limit in Equation 1 is a constant determined by users, $(Load)^P$ is inversely proportional to the current scaling factor I_SF.

Figure 4:
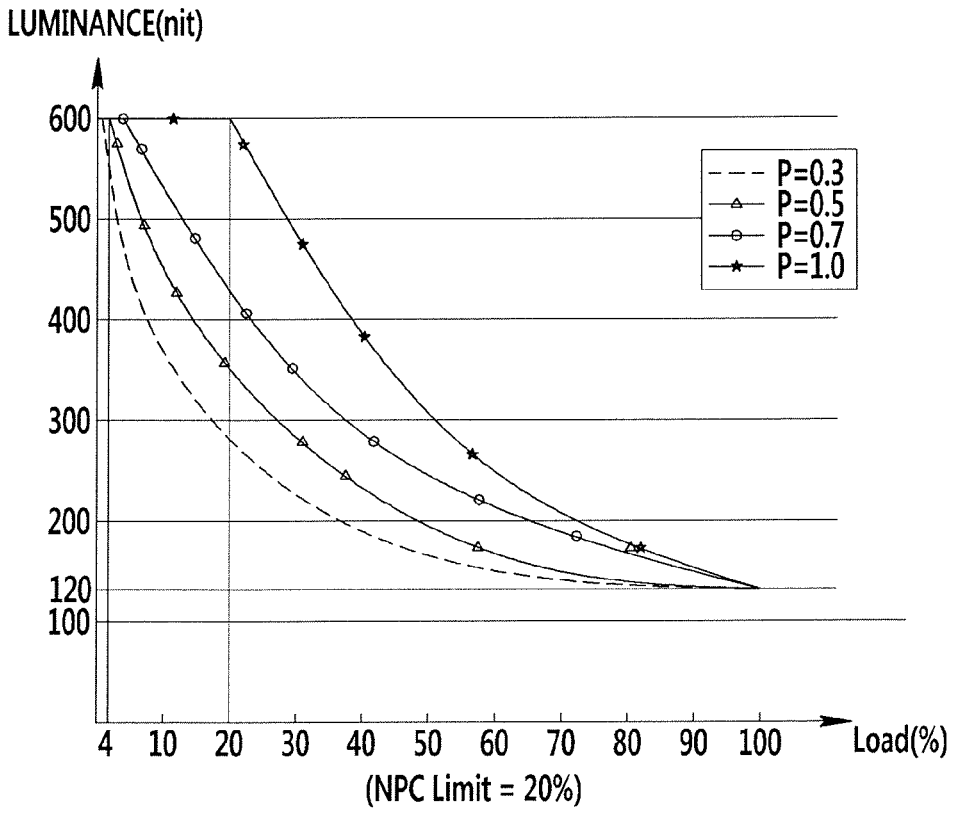
FIG. 4 is a graph showing a relationship between a load and a luminance depending on a load coefficient according to an exemplary embodiment of the present invention.

FIG. 4 is a graph showing a relationship between a load and a luminance depending on a change in a load coefficient P according to an exemplary embodiment of the present invention.

Although FIG. 4 shows that NPC Limit is 20%, the NPC Limit is not limited thereto. Luminance is proportional to current, and thus, Y-axis of the graph in FIG. 4 may be replaced by current. Therefore, the load-luminance curved line may be interpreted as a load-scaled current (SI) curved line. FIG. 4 shows that the maximum luminance of the panel is 600 (nit), but the maximum luminance of the panel is not limited thereto.

When NPC Limit is 20% and load coefficient(P) is 1, the load-SI curved line to satisfy Equation 1 is shown as the line with stars marked thereon in FIG. 4.

In the case that NPC Limit is 20% and Load coefficient P is 1, when the load is 100%, the maximum light emitting luminance of the load becomes 120 nit according to Equation 1 or the graph of FIG. 4, which is 20% of the maximum luminance, e.g., 600 nit of FIG. 4, of the panel, and when the load is 20%, the maximum light emitting luminance of the load becomes 600 nit that is 100% of the maximum luminance of panel.

When the current corresponding to the maximum luminance (e.g., 600 nit) of the panel is referred to as the maximum current maximum current PImax of the panel and the current corresponding to the maximum light emitting luminance of the load is referred to as the maximum current LImax of the load, a current scaling factor I_SF becomes a ratio of the maximum current LImax of the load to the maximum current PImax of the panel, in other words, the value of the maximum current LImax of the load when the maximum current PImax of the panel is 100.

The maxim current PImax of the panel is proportional to the maximum luminance (e.g., 600 nt) of the panel, and the maximum current LImax of the load is proportional to the maximum light emitting luminance of the load. Accordingly, according to an exemplary embodiment of the present invention, when the load is 100%, the current scaling factor I_SF becomes 0.2, and when the load is 20%, the current scaling factor I_SF becomes 1.0.

As the load decreases from 100% to 20%, the current scaling factor I_SF increases in inverse proportion to $(Load)^P$ as shown in FIG. 4. When the load is lower than 20%, the maximum luminance exceeds 600 nit according to Equation 1. However, since the maximum luminance of the panel is 600 nit, the maximum light emitting luminance of the load becomes constant at 600 nit. For example, when the load is lower than 20%, the maximum current LImax of the load cannot exceed the maximum current PImax of the panel and is saturated. For example, the current scaling factor I_SF becomes 1.0.

When the NPC Limit is 20% and the load coefficient (P) is 0.5, the load-SI curved line to satisfy Equation 1 is shown as the line with triangles marked thereon in FIG. 4.

In the case that NPC Limit is 20% and Load coefficient(P) is 0.5, when the load is 100%, the maximum light emitting luminance of the load becomes 120 (nit) according to Equation 1 that is 20% of the maximum luminance of the panel, and when the load is %, the maximum light emitting luminance of the load becomes 600 (nit) that is 100% of the maximum luminance of the panel.

To express the luminance as a current, when the current corresponding to the maximum luminance (e.g., 600 nit) of the panel is referred to as the maximum current PImax of the panel, and the current corresponding to the maximum light emitting luminance of the load is referred to as the maximum current LImax of the load, a current scaling factor I_SF becomes a ratio of the maximum current LImax of the load to the maximum current PImax of the panel, for example, the ratio of the maximum current LImax of the load when the maximum current PImax of the panel is 100.

The maxim current PImax of the panel is proportional to the maximum luminance (e.g., 600 nit) of the panel, and the maximum current LImax of the load is proportional to the maximum light emitting luminance of the load. According to an exemplary embodiment of the present invention, when the load is 100%, the current scaling factor I_SF becomes 0.2 and when the load is 4%, the current scaling factor I_SF becomes 1.0.

As the load decreases from 100% to 4%, the current scaling factor I_SF increases in inverse-proportion to $(Load)^P$ as shown in FIG. 4. When the load is lower than 4%, the maximum light emitting luminance of the load exceeds 600 nit according to Equation 1. However, since the maximum luminance of the panel is 600 nit, the maximum light emitting luminance of the load maintains 600 nit constantly. In other words, when the load is lower than 4%, the maximum current LImax of the load cannot exceed the maximum current PImax of the panel and is saturated. For example, the current scaling factor I_SF becomes 1.0.

In the case that NPC Limit is 20% and load coefficient P is 0.7 and in the case that NPC Limit is 20% and load coefficient P is 0.3, the current scaling factor I_SF may be calculated in substantially the same way as described above in connection with the cases where NPC limit is 20% and load coefficient P is 1 or 0.5.

Under the predetermined NPC Limit, the current scaling factor I_SF may be calculated as the load coefficient P is changed, and the load which becomes saturated (e.g., when I_SF=1.0) can be changed. When the proper NPC Limit and the load coefficient P are selected, the power consumption (P=VI) of the panel and luminance can be controlled.

Returning to FIG. 3, the data scaling unit 510 includes the data scaling factor generator 515 for generating the data scaling factor Data_SF. The data scaling unit 510 scales the data signal Data. The data scaling unit 510 generates the scaling data signal Data_S by multiplying the data signal Data supplied from the timing controller 400 by the scaling factor Data_SF.

The data scaling factor generator 515 generates the data scaling factor Data_SF based on the current scaling factor I_SF generated from the current scaling factor calculation unit 505.

The gamma scaling unit 520 includes the gamma scaling factor generator 525 for generating the gamma scaling factor Gamma_SF. The gamma scaling unit 520 scales the gamma value for gamma correction of the data signal.

The gamma scaling factor generator 525 generates the gamma scaling factor Gamma_SF based on the current scaling factor I_SF generated from the current scaling factor calculator 505.

The light emitting duty scaling unit 530 includes the light emitting duty scaling factor generator 535 for generating the light emitting scaling factor Duty_SF. The light emitting duty scaling unit 530 scales the light emitting duty of the pixel.

The light emitting duty scaling factor generator 535 generates the light emitting scaling factor Duty_SF based on the current scaling factor I_SF generated from the current scaling factor calculator 505.

The current scaling factor I_SF, the data scaling factor Data_SF, the gamma scaling factor Gamma_SF, and the light emitting scaling factor Duty_SF satisfy the following Equation 2:

$$(\text{Data_SF})*(\text{Gamma_SF})*(\text{Duty_SF})=(I_\text{SF}) \quad \text{[Equation 2]}$$

Here, Data_SF, Gamma_SF, Duty_SF and I_SF each have a value between 0 and 1.

Figure 5:
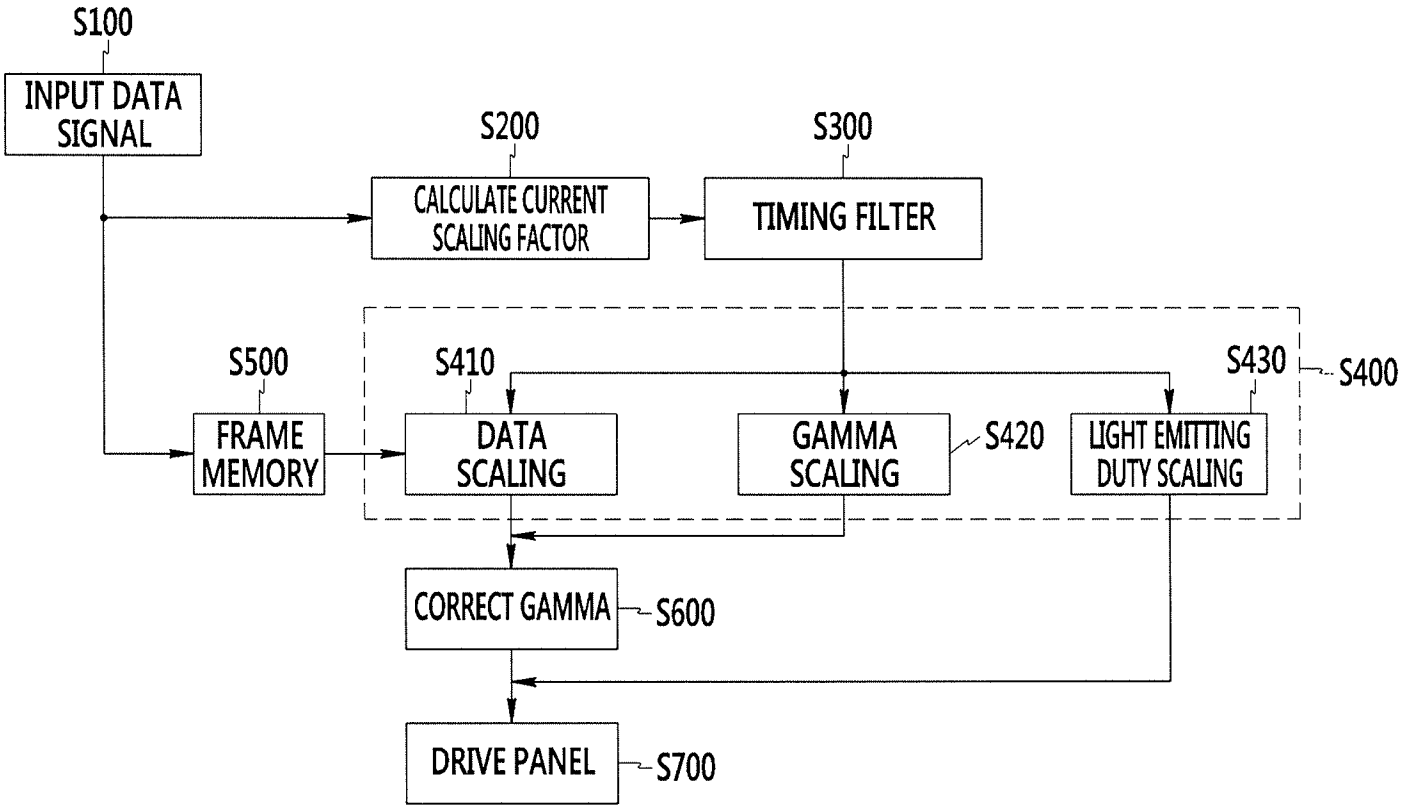
FIG. 5 is a flow chart showing an operation of a scaling unit according to an exemplary embodiment of the present invention.

FIG. 5 is a flow chart showing an operation of a scaling unit 500 according to an exemplary embodiment of the present invention.

Referring to FIG. 5, the data signal Data is input from the timing controller 400 (S100), and the input data signal Data is stored in the frame memory (S500).

The current scaling factor I_SF is calculated from the current scaling factor calculation unit 505 of the scaling unit 500 (S200).

As needed, the current scaling factor I_SF may be recalculated by a timing filter (S300). When the current is rapidly changed as the current scaling factor between frames is rapidly changed, the image quality deterioration may be prevented by setting a predetermined change threshold.

In the timing filter, when the prevention of over-current is needed, the over-current scaling factor IOC_SF different from the current scaling factor I_SF may be used.

For example, the current scaling factor I_SF of the current frame may be calculated by the curved line having the NPC Limit and the value P described above in connection with FIG. 4, and the over-current scaling factor IOC_SF may be calculated by the current load and a curved line for calculating the over-current scaling factor IOC_SF which enables the flow of a current more than a current obtained by the curved line used for calculating the current scaling factor I_SF.

For example, when the NPC Limit used for calculating the current scaling factor I_SF is 25%, the NPC Limit used for calculating the over-current scaling factor IOC_SF may be 30% to 35% (NPC OC Limit) which is slightly higher than the NPC Limit used for calculating the current scaling factor I_SF.

The over-current scaling factor IOC_SF calculated for preventing the over-current may be used instead of the current scaling factor I_SF.

Data scaling, gamma scaling, and light emitting duty scaling are performed in the scaling unit 500. The data signal corresponding to the light emitting gradation of the pixel is scaled in the data scaling unit 510 (S410), the gamma value for gamma correction of the data signal is scaled in the gamma scaling unit 520 (S420), and the light emitting duty of the pixel is scaled in the light emitting duty scaling unit (S430).

With the gamma value obtained by applying the gamma scaling factor Gamma_SF generated from the gamma scaling factor generator 525 of the gamma scaling unit 520, the gamma scaling unit 520 corrects the gamma for the scaling data signal Data_S which is a scaled data signal (S600).

The panel is driven by the scaled data signal and the scaled light emitting duty (S700).

Accordingly, the scaling unit 500 may control the current of the organic light emitting display device, thus reducing the power consumption of the organic light emitting display device.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A power control device for a display device, comprising: a current scaling factor calculation unit configured to calculate a current scaling factor according to an input data signal received from a timing controller that controls scan and data driving of the display device and a load of the input data signal; a data scaling unit configured to generate a data scaling factor based on the current scaling factor and configured to scale a data signal corresponding to a light emitting gradation of a pixel of the display device; a gamma scaling unit configured to generate a gamma scaling factor based on the current scaling factor and configured to scale a gamma value for gamma correction of the data signal, and a light emitting duty scaling unit configured to generate a light emitting scaling factor based on the current scaling factor and configured to scale a light emitting duty of the pixel.

2. The power control device for the display device of claim 1, wherein the current scaling factor calculation unit is configured to calculate the current scaling factor using the following Equation: (I_SF)*(Load)P=NPC Limit wherein, I_SF represents the current scaling factor, Load represents the load of the input data signal, and P represents a load coefficient which satisfies $0<P\leq 1$.

3. The power control device for the display device of claim 1, further comprising a timing filter configured to generate an over-current scaling factor by recalculating the current scaling factor.

4. The power control device for the display device of claim 3, wherein the timing filter, when calculating of the over-current scaling factor, is configured to use an over-current load coefficient P_OC different from the load coefficient used to calculate the current scaling factor.

5. The power control device for the display device of claim 4, wherein the over-current load coefficient is larger than the load coefficient.

6. The power control device for the display device of claim 1, wherein the current scaling factor, the data scaling factor, the gamma scaling factor, and the light emitting duty scaling factor satisfy the following Equation: (the data scaling factor)*(the gamma scaling factor)*(the light emitting duty scaling factor)=(the current scaling factor).

7. A power control method for a display device, comprising: calculating a current scaling factor according to an input data signal received from a timing controller that controls scan and data driving of the display device and a load of the input data signal; generating a data scaling factor based on the current scaling factor and scaling a data signal corresponding to a light emitting gradation of a pixel of the display device; generating a gamma scaling factor based on the current scaling factor and scaling a gamma value for gamma correction of the data signal, and generating a light emitting scaling factor based on the current scaling factor and scaling a light emitting duty of the pixel.

8. The power control method for the display device of claim 7, wherein the current scaling factor is calculated using the following Equation:

$$(1SF)*(Load)^{P}=NPC\ Limit$$

wherein, I_SF represents the current scaling factor, Load represents the load of the input data signal, and P represents a load coefficient, which satisfies ($0<P\leq 1$).

9. The power control method for the display device of claim 7, further comprising generating an over-current scaling factor by recalculating the current scaling factor.

10. The power control method for the display device of claim 9, wherein the over-current scaling factor is calculated using an over-current load coefficient P OC different from the load coefficient used to calculate the current scaling factor wherein P_OC is the over-current load coefficient which satisfies $0<P_OC\leq 1$.

11. The power control method for the display device of claim 10, wherein the over-current load coefficient is larger than the load coefficient.

12. The power control method for the display device of claim 7, wherein the current scaling factor, the data scaling factor, the gamma scaling factor, and the light emitting duty scaling factor satisfy the following equation:

(the data scaling factor)*(the gamma scaling factor)*(the light emitting duty scaling factor)=(the current scaling factor).

13. A power control device for a display device, comprising: a current scaling factor calculation unit configure to calculate a current scaling factor using the following Equation: $(I_SF)*(Load)^{P}=NPC\ Limit$ wherein, I_SF is the current scaling factor, Load is a load of a data signal received from a timing controller that controls scan and data driving of the display device corresponding to a light emitting gradation of a pixel of the display device, and P is a load coefficient which satisfies $0<P\leq 1$; a data scaling unit configured to generate a data scaling factor based on the current scaling factor and configured to scale the data signal; and a gamma scaling unit configured to generate a gamma scaling factor based on the current scaling factor and configured to scale a gamma value for gamma correction of the data signal.

* * * * *